United States Patent [19]

McRaine

[11] Patent Number: 4,829,801

[45] Date of Patent: May 16, 1989

[54] CABLE STRAIGHTENING APPARATUS

[76] Inventor: Lance W. McRaine, 3786 Cambridge Street, North Burnaby, British Columbia, Canada, V5C 1G1

[21] Appl. No.: 926,932

[22] Filed: Nov. 3, 1986

[51] Int. Cl.[4] ..... B21D 3/02

[52] U.S. Cl. ..... 72/164; 72/249

[58] Field of Search ..... 72/164, 165, 160, 249, 72/161, 181, 182; 140/147

[56] References Cited

U.S. PATENT DOCUMENTS

| | | | |
|---|---|---|---|
| 973,571 | 10/1910 | Shuster | 72/160 |
| 1,042,131 | 10/1912 | Locke | 72/165 |
| 1,252,115 | 1/1918 | Hughes | 72/164 |
| 1,841,824 | 1/1932 | Kruse | 72/164 |
| 2,027,564 | 1/1936 | Stein et al. | 72/249 |
| 2,445,615 | 7/1948 | Forsman | 72/165 |
| 2,746,513 | 5/1956 | Kiesow et al. | 72/164 |
| 2,837,138 | 6/1958 | De La Motte | 72/165 |
| 3,453,852 | 7/1969 | Valente | 72/164 |
| 3,815,398 | 6/1974 | McClain | 72/181 |
| 4,286,452 | 9/1981 | Schneider | 72/164 |

FOREIGN PATENT DOCUMENTS

| | | | |
|---|---|---|---|
| 197114 | 4/1978 | German Democratic Rep. | 72/164 |
| 75221 | 5/1982 | Japan | 72/160 |
| 507029 | 6/1945 | United Kingdom | 72/164 |

*Primary Examiner*—Daniel C. Crane

*Attorney, Agent, or Firm*—Townsend & Townsend

[57] ABSTRACT

Apparatus to straighten wire ropes. A first frame has a plurality of rollers sequentially mounted on it. A channel is formed in the periphery of each roller. The channels are generally semi-circular in cross section and of a pedetermined radius. The rollers can be driven. A second frame is reciprocable relative to the first and also has a plurality of rollers sequentially mounted on it, above the rollers of the first frame, and in the same plane as the first rollers. A channel is formed in the periphery of the roller. The channels in the rollers form a pathway through the apparatus for a wire rope. The second frame can be reciprocated and, with it, the roller on it. All the rollers can be driven at the same speed. There is an opening in the first frame, parallel to and coextensive with the above pathway through the rollers.

8 Claims, 2 Drawing Sheets

CABLE STRAIGHTENING APPARATUS

FIELD OF THE INVENTION

This invention relates to an apparatus to straighten wire ropes.

DESCRIPTION OF THE PRIOR ART

Wire ropes are much used in industry widely used in docks and shipping, but they also find wide application wherever heavy duty, flexible links are required.

Wire ropes are expensive. If they become kinked their further use may be limited and the rope is wasted. In these circumstances equipment exists to straighten wire ropes. In view of the great strength of the ropes the equipment to straighten them is frequently heavy duty. Virtually the standard method of straightening ropes is to force the twisted rope between grooved rollers. The rope is pulled by a vehicle, typically a pallet-carrying vehicle, or, conversely, the machine may be pulled and the rope kept still. In all cases the rope moves longitudinally relative to the machine through a channel of fixed dimensions.

The equipment performs well but its use can be inconvenient and the design of such equipment is such that it cannot be used to straighten loops of wire rope. Loops of wire are commonly used and, in these circumstances, it is a serious shortcoming in the prior art equipment that the loops cannot be straightened when they are kinked.

Specific prior art known to applicant comprises U.S. Pat. Nos. 3,893,316 to Simich; 2,963,071 to Krynytzky; 2,517,309 to Heller; 4,412,565 to Broberg; 4,380,921 to Matsui; and 3,457,754 to Hagemann. Of these patents Simich teaches a bale tie straightening apparatus using a plurality of rollers. Krynytzky is concerned with the straightening of sheet metal strips. Heller is a relatively complex piece of equipment to carry out a relatively complex task of straightening in several planes. Broberg is a wire straightening tool in which the wire straightening members overlap. Matsui is a roll leveller and Hagemann again is a roller straightening machine.

SUMMARY OF THE INVENTION

Accordingly the present invention provides apparatus to straighten wire ropes in which it is believed that the principal disadvantages of the prior art are avoided. In particular the machine is easy to use, does not require an additional vehicle, either to move the rope or the apparatus, and can be used to straighten loops.

Accordingly the present invention is an apparatus to straighten wire ropes comprising a first frame; a plurality of first rollers sequentially mounted on the first frame; a channel formed in the periphery of each first roller, the channels being generally semi-circular in cross section and of a predetermined radius; drive means for the plurality of first rollers; a second frame, reciprocable relative to the first; a plurality of second rollers sequentially mounted on the second frame, above the first rollers and in the same plane as the first rollers; a channel formed in the periphery of each second roller, corresponding to the channel in the first rollers; the channels in the first and second rollers forming a pathway through the apparatus for a wire rope; means to reciprocate the second frame and thus the second rollers; means to drive the second rollers at the same speed as the first rollers; and an opening in the first frame, parallel to and coextensive with the pathway formed by the channels in the first and second rollers.

DRAWINGS

Aspects of the invention are illustrated, merely by way of example, in the accompanying drawings in which.

DESCRIPTION OF THE PREFERRED EMBODIMENTS

Figure 1:
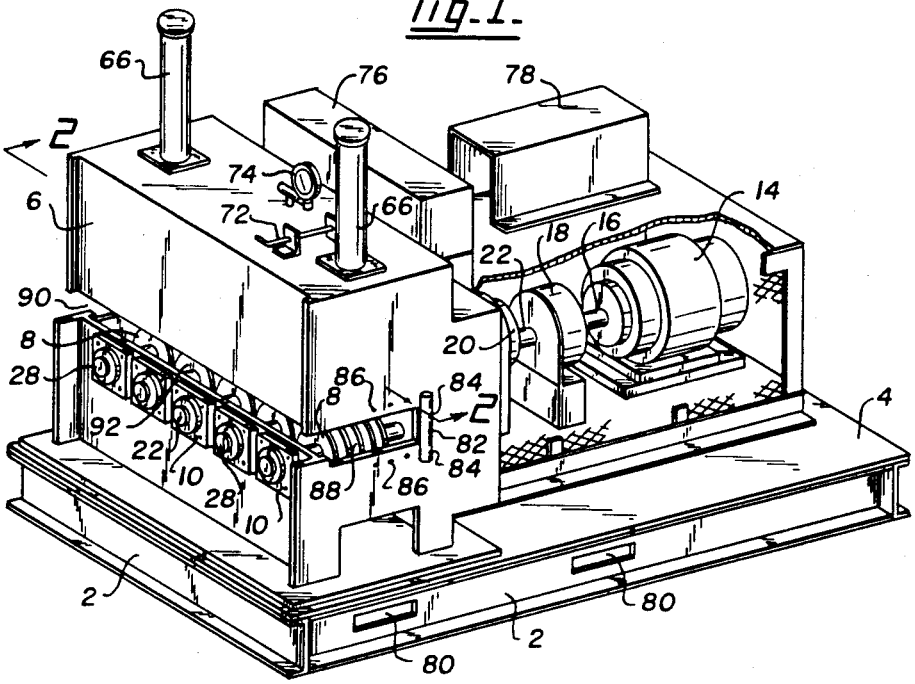
FIG. 1 is a perspective view of an apparatus according to the present invention.

The drawings show an apparatus to straighten wire ropes. As shown most clearly in FIG. 2 the apparatus comprises main frame of appropriately robust construction and typically comprising a base 2 of C-beams supporting a base plate 4 on which is a first frame 6. As shown particularly in FIG. 2 a plurality of first or lower rollers 8 is mounted on the first frame 6. The rollers 8 are mounted in bearing blocks 10, as shown in FIGS. 1 and 3.

Figure 3:
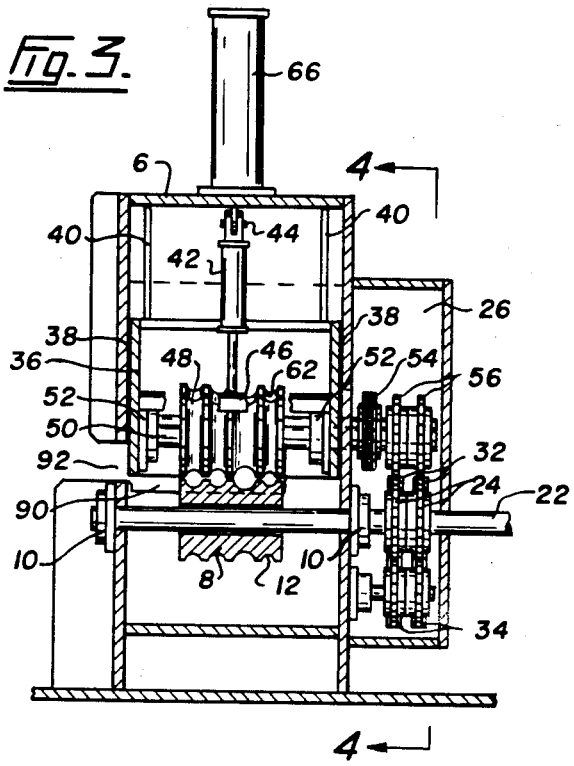
FIG. 3 is a section on the line 3—3 in FIG. 2.

As shown particularly in FIG. 3 a channel 12 is formed in the periphery of each first roller 8. The channels 12 are generally semi-circular in cross section and of a predetermined radius. In the illustrated, preferred embodiment, there are a plurality of sets of first rollers 8 and the channels 12 in each set are the same and differ in size from the channels 12 of the other sets of rollers 8. These channels 12 correspond to the external diameter of commonly available wire ropes.

There are drive means for the first rollers 8. As shown particularly in FIG. 1 there is an electric motor 14 having an output shaft 16 driving through a transmission 18, (for example a hydrostatic transmission) and a speed reducer 20 shown only partially in FIG. 1. A typical ratio for the speed reducer is about 25 to 1. A main drive shaft 22 (see FIG. 3) extends outwardly from the speed reducer 20 and one first roller 8 is mounted on the drive shaft 22 to turn with the shaft. As shown particularly in FIGS. 3 and 4 there is a sprocket 24 on the main drive shaft 22 and located in a compartment 26 adjacent the gear reducer 20.

Figure 2:
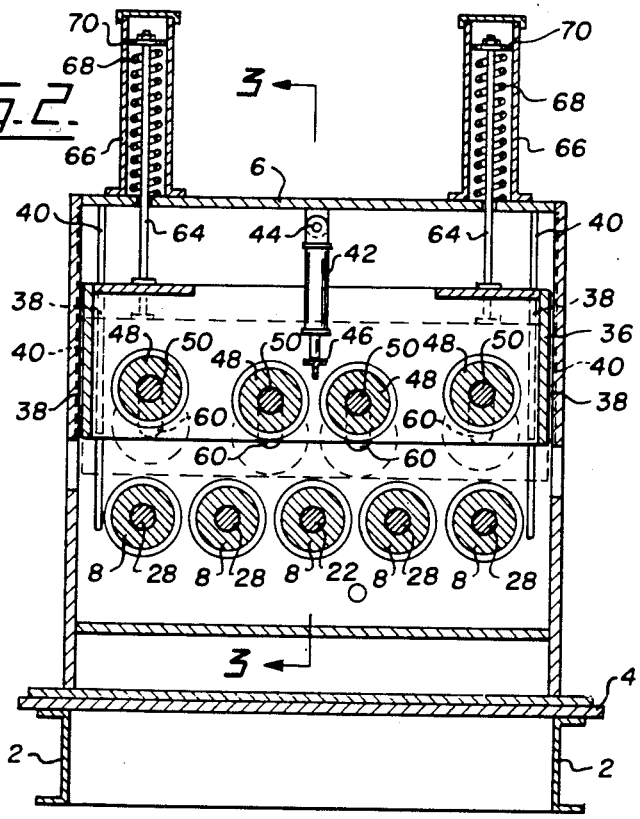
FIG. 2 is a section on the line 2—2 in FIG. 1.
Figure 4:
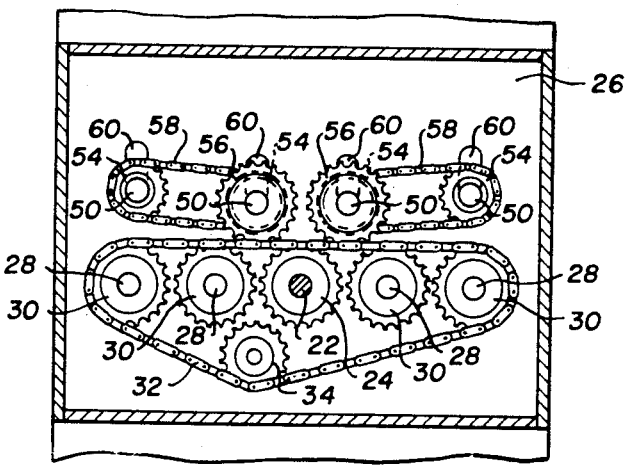
FIG. 4 is a section on the line 4—4 in FIG. 3.

All the other first rollers 8 are mounted on shafts 28, as shown in FIG. 2, and each shaft is provided with a sprocket 30, shown in FIG. 4. There is a drive chain 32 that engages each of the sprockets 24 and 30. The arrangement is such that as the drive shaft 22 is turned the driven shafts 28 are turned and thus all the first rollers 8 are driven. FIG. 4 shows the conventional use of a chain tensioner 34 to ensure the proper tension is maintained in the drive chain 32.

There is a second frame 36, reciprocable relative to the first frame 6. To ensure correct alignment at all times the second frame 36 runs on track members 38 attached to the second frame 36 and engageable in recesses 40 formed in the first frame 6.

In the illustrated embodiment a hydraulic cylinder 42 is attached to the first frame 6 at 44 and extends to engage a cross member 46, shown particularly in FIG. 3, attached to the first frame 6.

There is a plurality of second rollers 48 sequentially mounted on the second frame 36 on shafts 50 as shown in FIG. 2. Conventional bearing blocks 52 may be used, as shown particularly in FIG. 3. Each shaft 50 for the second rollers 48 is provided with a sprocket 54 as shown in FIGS. 3 and 4—although only two sprockets 54 are shown. FIG. 4 illustrates that the two inner shafts 50 also have sprockets 56 mounted on them that are positioned to engage the drive chain 32 for the first rollers 8 when the second rollers 48 are moved towards the first rollers 8 with the second frame 36. There are then drive means on these two shafts 50 extending to drive the remaining shafts 50 to ensure that all second rollers 48 are driven. As shown particularly in FIG. 4 and in FIG. 3, the drive means comprises chains 58 engaging the sprockets 54 on the second roller shafts 50. As shown particularly in FIG. 4 there are slots 60 in the back of the first frame 6, communicating with compartment 26 so that the shafts 50 may move upwardly and downwardly without contacting the first frame 6.

A channel 62 is formed in the periphery of each second roller 48 and each channel 62 corresponds to the aligned channel 12 in the first rollers 8. Again in the illustrated preferred embodiment the second rollers 48 are arranged in sets, each set aligned with a set of first rollers 6 and the dimensions of the channel 62 in each second rollers 48 match the dimensions of the channel 12 in the first roller 8 with which it is aligned.

As shown particularly in FIG. 2 rods 64 extend upwardly from the second frame 36 into housings 66. Springs 68 are located within the housings 66 and plates 70 ensure that as the second frame 36 moves downwardly the springs 68 are compressed.

In a preferred embodiment the drive means for the first rollers is reversible. A reverse lever 72 is connected by a Bowden cable (not shown) to the transmission 18. A gauge 74 indicates the pressure in the hydraulic cylinder 42 and a fluid reservoir 76 is provided for fluid for cylinder 42 and transmission 18. The necessary wiring is not shown as the necessary connections are clearly apparent to the man skilled in the art. The wiring is desirably protected by hood 78. Openings 80 are provided in the main frame so that the apparatus may be moved from location to location by a fork lift truck.

As shown in FIG. 1 to ensure that the wire rope to be straightened is aligned with the correct set of first and second rollers an abutment member 82 is provided so that any rope contacting the surface of the abutment 82 will be properly aligned with the appropriate pathway formed by cooperating channels 12 and 62. Bolts 84 extend through the abutment member 82 to engage in threaded openings 86 so that the abutment member 82 can be moved across the machine to ensure that the correct channels 12 and 62 are aligned with the member 82.

The first frame 6 is formed with an opening 88 for wire rope at one end and a second opening 90 at the other. A further opening 92 extends between openings 88 and 90 and is parallel to and coextensive with the pathway formed by channels 12 and 62.

To use the apparatus of the present invention the abutment member 82 is moved to ensure that its edge aligns with the pathway through the machine that is desired, that is whose channels 12 and 62 form a pathway of internal diameter that matches the outside diameter of the wire rope to be straightened. The wire rope to be straightened is laid over the first rollers 8. The wire rope may be a loop in which case the edge of the loop will be fed through the opening 92 in the first frame 6 parallel to and coextensive with the pathway formed by the channels 12 and 62 in the first and second rollers 8 and 48.

When the cable is properly positioned hydraulic pressure is applied to the cylinder 42 moving second frame downwardly on tracks 38 until the position shown in dotted lines in FIG. 2 is achieved. As the second frame moves downwardly springs 68 are compressed. Motor 14 is started when the wire rope is properly engaged in the channels 12 and 62 and the rolls turn, forcing the wire rope through the machine and also straightening the rope.

At the conclusion of the straightening operation hydraulic pressure is released in cylinder 42 and springs 68 extend to move the second frame 36 to the solid line position shown in FIG. 2. The wire rope may be moved from the machine. In the case of a loop it is taken out through opening 92.

Thus the present invention teaches an apparatus for straightening wire ropes that is sophisticated and efficient and yet simple to use. Although it is not moved in operation, as its rollers are driven, nevertheless the provision of openings 80 ensures that the machine can easily be moved around on a commonly available pallet loader

I claim:

1. Apparatus to straighten wire ropes as the ropes are fed along a path comprising:

a first frame;

a plurality of first rollers sequentially mounted along said path on the first frame;

a channel formed in the periphery of each first roller, the channels being generally semi-circular in cross section and of a predetermined radius;

drive means for the plurality of first rollers comprising a motor driving through a transmission and a speed reducer with a main drive shaft extending from the speed reducer;

a sprocket on the main drive shaft;

one first roller mounted on the drive shaft to turn with the shaft;

driven shafts mounting each of the remaining first rollers;

a sprocket on each driven shaft;

a continuous drive chain engaging and forming a loop about all said sprockets whereby drive from the drive shaft is transmitted to all the shafts of all the first rollers, said sprockets engaging an inside of the loop formed by said continuous chain;

a second frame, reciprocable relative to the first frame;

a plurality of second rollers sequentially mounted along said path on the second frame, above the first rollers and in the same plane as the first rollers, said first and second rollers being offset relative one another.

a channel formed in the periphery of each second roller, corresponding to the channel in the first roller;

the channels in the first and second rollers forming a pathway through the apparatus for a wire rope;

means to reciprocate the second frame and thus the second rollers relative to said first frame;

means to drive the second rollers at the same speed as the first rollers comprising shafts carrying each of the second rollers;

sprockets mounted on at least two of said shafts of said second rollers and positioned to engage the outside of the loop of said drive chain of the first rollers when the second rollers are moved towards the first rollers;

drive means on said two of said second rollers extending to drive the remaining second rollers, said drive means being separate from said continuous drive chain; and an opening in the first frame, parallel to and coextensive with the pathway formed by the channels in the first and second rollers.

2. Apparatus as claimed in claim 1 including a plurality of sets of first rollers, the channels in each set differing in size from the channels of the other sets;

a corresponding plurality of sets of second rollers, formed with corresponding channels.

3. Apparatus as claimed in claim 1 including means to control the tension of the drive chain.

4. Apparatus as claimed in claim 1 in which the drive means extending to drive the remaining second rollers comprises chains engaging secondary sprockets on said shafts carrying said second rollers.

5. Apparatus as claimed in claim 1 in which the second frame moves on tracks.

6. Apparatus as claimed in claim 1 in which the means to reciprocate the second frame comprises a fluid cylinder attached to the second frame to drive the second frame downwardly;

compression springs to return the frame when fluid pressure to the fluid cylinder is released.

7. Apparatus as claimed in claim 1 in which the drive means for the first rollers is reversible.

8. Apparatus as claimed in claim 1 including means to ensure a wire rope is properly aligned with the pathway.

* * * * *